US005345371A

United States Patent [19]

Cunningham et al.

[11] Patent Number: 5,345,371

[45] Date of Patent: Sep. 6, 1994

[54] LIGHTING FIXTURE

[76] Inventors: David W. Cunningham, 8442 Hollywood Blvd., Los Angeles, Calif. 99069; Gregory F. Esakoff, 9131 Santiago Dr., Huntington Beach, Calif. 92646

[21] Appl. No.: 972,141

[22] Filed: Nov. 5, 1992

[51] Int. Cl.[5] ..... F21V 7/00

[52] U.S. Cl. ..... 362/297; 362/322; 362/348

[58] Field of Search ..... 362/293, 297, 306, 347, 362/348, 349, 346, 282, 321, 322

[56] References Cited

U.S. PATENT DOCUMENTS

| | | | |
|---|---|---|---|
| 1,595,533 | 8/1926 | Weems | 362/349 X |
| 3,408,501 | 10/1968 | Thompson | 362/322 |
| 3,662,165 | 5/1972 | Osteen et al. | 362/297 |
| 3,704,928 | 12/1972 | Coombs et al. . | |
| 3,979,160 | 9/1976 | Anderson et al. . | |
| 4,061,912 | 12/1977 | Levasseur . | |
| 4,187,534 | 2/1980 | Tichenor et al. . | |
| 4,210,955 | 7/1980 | Labrum | 362/321 |
| 4,233,650 | 11/1980 | Hagner | 362/322 |
| 4,242,727 | 12/1980 | de Vos et al. | 362/346 |
| 4,425,599 | 1/1984 | Rieder et al. | 362/282 |
| 4,482,942 | 11/1984 | Blaisdell et al. . | |
| 4,517,630 | 5/1985 | Dieffenbach et al. . | |
| 4,519,021 | 5/1985 | Oram . | |
| 4,545,000 | 10/1985 | Fraley et al. | 362/297 |
| 4,911,166 | 3/1990 | Leighton et al. . | |
| 4,994,948 | 2/1991 | Cooch | 362/348 |
| 5,014,166 | 5/1991 | Draper et al. . | |
| 5,160,192 | 11/1992 | Sugawara . | |

FOREIGN PATENT DOCUMENTS

| | | | |
|---|---|---|---|
| 784478 | 6/1960 | France | 362/349 |

OTHER PUBLICATIONS

"Range of Spotlights-1000/1200/2000W," published by ADB Lighting Systems, undated.

"Silhouette 90," published by CCT Lighting Inc., undated.

"500-750 Watt 6, Klieglight With Rotating Front Barrel," published by Klieg, 1976.

"ENIZOOM-The New Generation of Zoom Profile Spots From Niethammer," published by Emil Niethammer Elektrotechnische Fabrik GmbH, undated.

"The New Enhanced 1200 Range," published by Selecon, undated.

"Cantata-A Family of Theatrical Luminaires," published by Strand Lighting, 1991.

"New Lanterns For a New Lamp," published by Strand Lighting, 1987.

"Data Specifications for TRATTO-2 15/28 & 22/40, TRATTO-2C 9/18 & 19/42, TIPO 15/28 & 22/40, ACUTO 9/15, 12/22 & 19/32, COMMA 16/28 & 22/35, and COMMA 26 & 37/48", published by Teatro Srl, undated.

"Which 1kW Profile Spot?" undated.

*Primary Examiner*—Richard A. Bertsch
*Assistant Examiner*—M. Kocharov
*Attorney, Agent, or Firm*—Pretty, Schroeder, Brueggemann & Clark

[57] ABSTRACT

An improved lighting fixture is disclosed for imaging a high-intensity beam of light at a distant location. A specially-faceted near-elliptical reflector cooperates with a gate aperture and a single aspheric lens to produce a beam that incorporates a very high proportion of emitted visible light, while the reflector has a dichroic coating that reflects only a low proportion of infrared light. The projected beam thereby has a relatively low energy density, such that the front portion of the fixture can be reduced substantially in size and weight. The gate is selectively rotatable relative to the fixture's rear housing.

4 Claims, 7 Drawing Sheets

LIGHTING FIXTURE

BACKGROUND OF THE INVENTION

This invention relates generally to lighting fixtures and, more particularly, to lighting fixtures adapted to image a high-intensity beam of light at a distant location.

Lighting fixtures of this particular kind are commonly used in theater, television and architectural lighting applications. Many such fixtures include an ellipsoidal or near-ellipsoidal reflector with a single lamp located generally coincident with the reflector's longitudinal axis. The reflector has two general focal regions, and the lamp is positioned generally with its filaments located at or near one of those focal regions such that light emitted from the filaments is reflected by the reflector generally toward the second focal region. A gate aperture is located at that second focal region, and shutters, patterns and the like can be used at that gate for shaping the projected beam of light. A lens located beyond the gate images light passing through the gate aperture at a distant location.

One problem commonly encountered by lighting fixtures of this kind is that an excessive amount of light emitted by the lamp is not incorporated into the projected beam, but instead is misdirected and absorbed by the shutters, patterns, gate and other internal components of the fixture. This wastes electrical energy and leads to undesired heating of the fixture. In many instances, the shutters and patterns can be warped by the excessive heat and therefore need to be frequently replaced.

Another problem encountered in lighting fixtures of this kind is that the imaged light beam can sometimes have an intensity that varies radially such that a concentric ring pattern is provided. This undesired concentric ring pattern occurs because of the particular kind of filament used in the lamp, e.g., a coiled coil. Each point on the reflector reflects light toward the gate so as to produce a magnified image of the filament, and the superposition of the images resulting from all points on the reflector sometimes can provide the concentric ring pattern.

This undesired concentric ring pattern has been overcome by providing the reflector with a plurality of small, trapezoidal facets, typically flat sections, that function to blur the projected image. The facets have edges that are arranged both radially and circumferentially. Although such a reflector structure is generally effective in eliminating the concentric ring effect, it is believed that this solution misdirects an excessive amount of light so as not to be incorporated into the projected beam.

Another drawback to lighting fixtures of the kind described above is that the fixture projects an undesired amount of infrared light along with the desired visible light. This unduly heats the area on which the projected light is imaged, which in the case of theater, television and some architectural lighting can lead to substantial discomfort. Reflecting undesired infrared light also leads to undesired heating of the pattern and shutters located at the gate and of any colored media or gels located forwardly of the lens. In some cases, highly absorptive media, such as blue gels, burn out very quickly or cannot be used at all.

It should therefore be appreciated that there is a need for an improved lighting fixture that images a beam of light at a distant location, yet that is not unduly wasteful of energy and that does not unduly transmit undesired infrared light. The present invention fulfills this need.

SUMMARY OF THE INVENTION

The present invention is embodied in a lighting fixture for use in combination with a lamp in imaging a beam of light at a distant location, while utilizing a substantially greater proportion of visible light emitted by the lamp. At the same time, the fixture images a substantially lower proportion of infrared light emitted by the lamp. A substantially more efficient lighting fixture thereby is provided.

More particularly, the lighting fixture of the invention is especially adapted for use in combination with a lamp having a plurality of elongated filaments with axes arranged substantially uniformly around a central longitudinal axis. The fixture includes a concave reflector having a base at one end and a mouth at the other end, the reflector being substantially circumferentially symmetrical about a longitudinal axis. The fixture further includes means for supporting the lamp at the reflector's base, with the lamp's central longitudinal axis substantially coincident with the reflector's longitudinal axis. The reflector thereby reflects light emitted by the lamp filaments and forms a beam that is imaged at a predetermined location.

In accordance with one feature of the invention, the concave reflector includes a plurality of radially-extending facets arranged substantially uniformly around its circumference, the facets functioning to redirect the light in a way that provides the imaged beam with a desired intensity distribution, while redirecting very little of the light outside the image spot. The facets extend substantially from the reflector's base to its mouth, and each facet is substantially flat in the reflector's circumferential direction, but curved in the reflector's radial direction. In addition, the facets increase in number with increasing distance from the reflector's base. No orthogonal faceting exists along the radially-extending facets, such that radial cross-sections through the reflector are continuously curved.

The concave reflector can take the form of an ellipsoid or near-ellipsoid having generally two focal regions. The lamp is positioned with its filaments located at or near one of those focal regions such that the reflector reflects light emitted from the filaments toward the second focal region. A gate aperture is positioned at the second focal region, for use in defining the peripheral shape of the imaged light beam. A lens positioned beyond the gate images the light at the distant location.

In another feature of the invention, the reflector is constructed of borosilicate glass coated with multiple thin-film layers of a dielectric coating, which has a substantially higher reflectance at visible wavelengths than at infrared wavelengths. This minimizes the amount of projected infrared light and thereby minimizes undesired heating of objects located at the site of the imaged beam. It also limits the amount of radiant energy passing through one or more colored media or gels located forward of the lens, thereby allowing the sizes of those gels, as well as the size of the lens, to be substantially reduced. Minimizing the amount of reflected infrared light also reduces undesired heating of the shutters, patterns and front barrel of the fixture.

In still another feature of the invention, the lens for imaging the projected light includes a single, aspheric lens configured to substantially correct spherical aberration, astigmatism and field curvature in the projected image. Because just a single lens element is required, the total reflection loss occurring at the lens surfaces can be reduced significantly from that occurring in prior fixtures, which typically included two spherical lenses.

In yet another feature of the invention, a shutter/pattern assembly located at the fixture's gate aperture is carried by a front barrel assembly that is selectively rotatable relative to a rear housing for the concave reflector and lamp. This facilitates a convenient shaping of any selected part of the projected beam.

Further, the lamp position is conveniently adjusted relative to the concave reflector using two concentric knobs mounted on a rear assembly that supports the lamp. One knob moves the lamp along the fixture's longitudinal axis, while the other knob, when loosened, allows the lamp's transverse position relative to that axis to be selected. Removing and replacing the lamp assembly from the remainder of the fixture, as for example when replacing a burned-out lamp, does not affect the lamp's position adjustment.

Other features and advantages of the present invention should become apparent from the following description of the preferred embodiment, taken in conjunction with the accompanying drawings, which illustrate, by way of example, the principles of the invention.

DESCRIPTION OF THE PREFERRED EMBODIMENT

Figure 1:
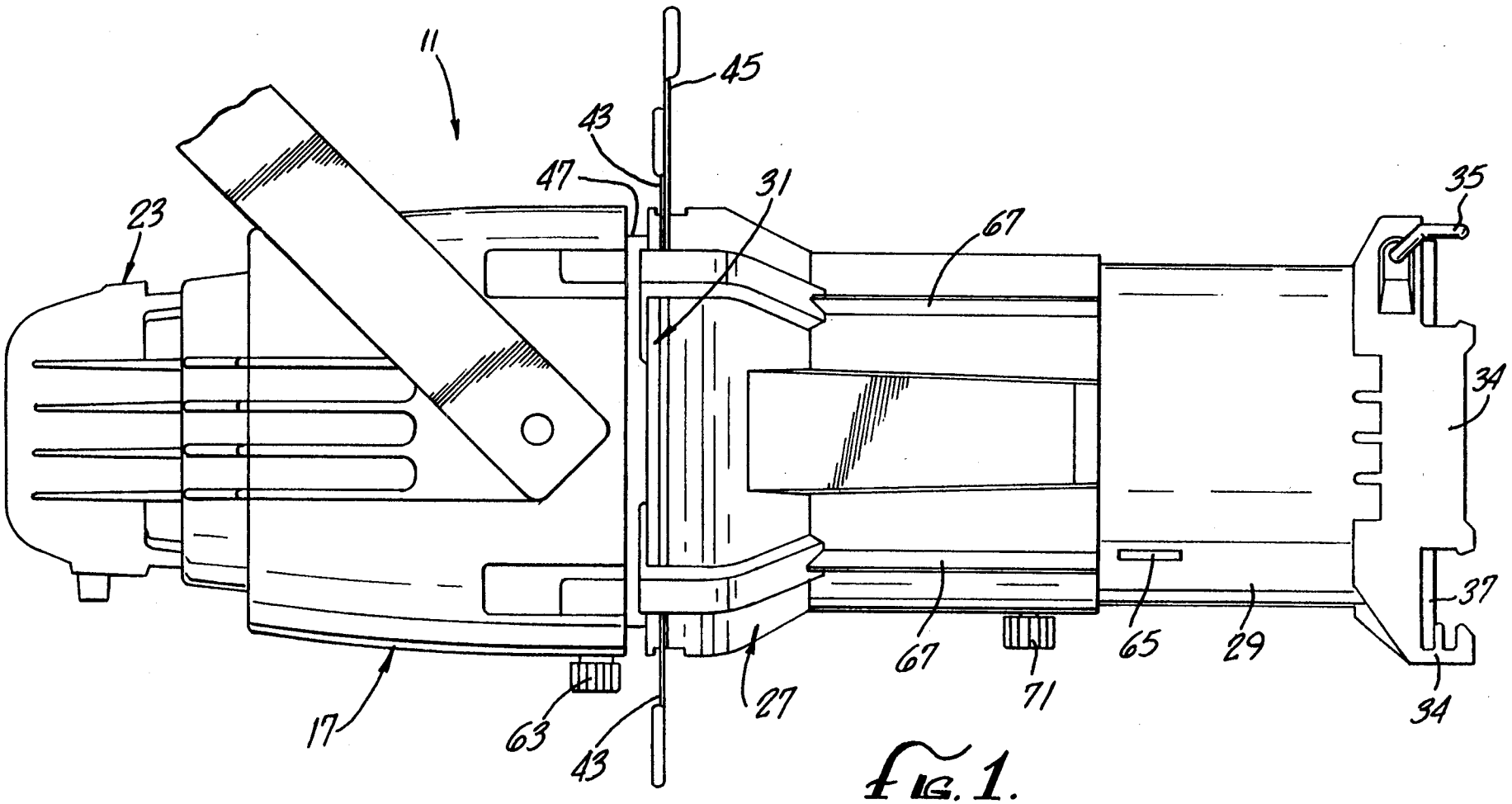
FIG. 1 is a side, elevational view of a lighting fixture embodying the present invention.
Figure 2:
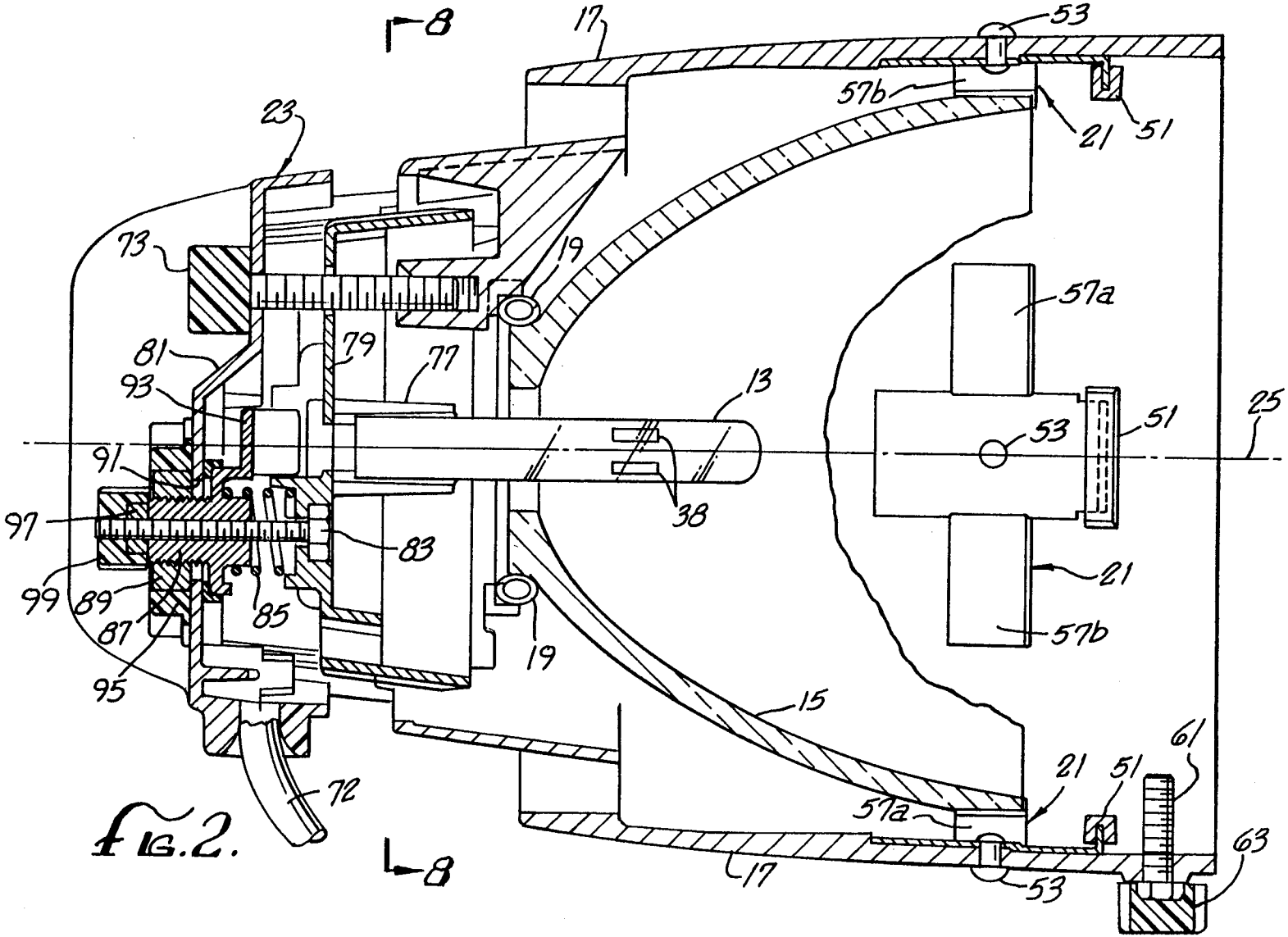
FIG. 2 is a side, sectional view of the rear portion of the lighting fixture of FIG. 1, shown with a lamp being positioned within the fixture's near-ellipsoidal reflector.
Figure 9:
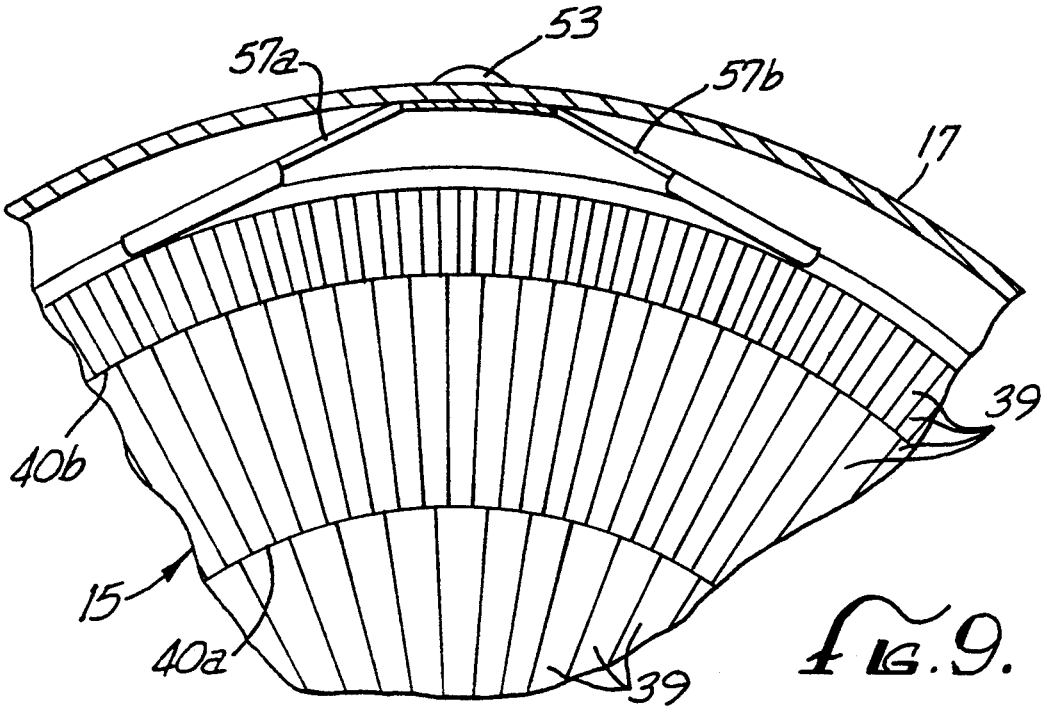
FIG. 9 is a sectional view of the lighting fixture, taken in the direction of the arrows 9—9 in FIG. 3.

With reference now to the drawings, and particularly to FIGS. 1 and 2, there is shown a lighting fixture 11 for use in combination with a lamp 13 in projecting an intense beam of light for imaging at a distant location. The lighting fixture is particularly adapted for use in theater, television and architectural lighting applications. The fixture includes a near-ellipsoidal reflector 15 located within a generally cylindrical rear housing 17. The reflector is secured to the housing at the reflector's base by an assembly that includes a coil spring 19 and at the reflector's mouth by four spring clips 21 (FIGS. 2, 7 and 9) positioned uniformly around the housing's inner periphery. A lamp receptacle or burner assembly generally designated by the reference numeral 23 is secured to the rear of the housing and supports the lamp 13 in a selected coaxial position within the reflector. In particular, the lamp is positioned with its central longitudinal axis substantially coincident with a central longitudinal axis 25 of the reflector. One suitable lamp for use in the lighting fixture of the invention is disclosed in copending and commonly-assigned application for U.S. patent application Ser. No. 07/724,841, filed Jul. 7, 1991 and entitled "Incandescent Illumination System."

With reference now to FIGS. 1–4, there is shown a generally cylindrical front barrel 27 and a lens tube 29 secured to the forward end of the housing 17. The front barrel carries at its rearward end a gate assembly 31, and the lens tube carries a lens 33 at one of several factory-selected locations along its length and further includes guides 34 and a pivotable retainer 35 for carrying one or more colored media 36 in a media frame 37 at its forward end. Light emitted by filaments 38 of the lamp 13 is reflected by the reflector 15 through the gate to the lens, which forms a generally collimated beam that is projected through the media and away from the fixture 11. The different lenses and factory-selected lens positions allow for selection of the projected beam's field angle.

The near-ellipsoidal reflector 15 is configured such that, by positioning the lamp 13 with its filaments 38 substantially coincident with a rough focal region of the reflector, substantially all points on the reflector reflect emitted light through the gate aperture 31 toward the lens 33. The gate aperture is located approximately at a second rough focal region of the reflector. Each point on the reflector produces at the gate an image of the lamp filaments, as those filaments appear from that point on the reflector. The filament image is magnified by a factor corresponding to the ratio of the distance from the point on the reflector to the gate divided by the distance from the point on the reflector to the filaments.

The filament images produced at the gate 31 by the entire collection of points on the reflector 15 combine to reinforce each other and form a composite image. The lens 33 then functions to project this very same image at a distant location, such as a theater stage. This is achieved by selectively positioning the lens forward of the gate by a distance corresponding generally to the lens' focal length.

The composite image produced at the gate 31 and thus imaged by the lens 33 at a distant location generally can have an undesired non-uniform intensity distribution. Localized regions of high intensity, or hot spots, can occur wherever the filament images produced by elemental areas on the reflector 15 reinforce each other. In the past, this undesirable characteristic was sought to be eliminated by providing the reflector with a plurality of small, flat, trapezoidal facets across its surface. This tended to provide a more desirable intensity distribution, but at the expense of redirecting an excessive amount of light in directions other than through the gate aperture and lens. This led to undue inefficiency and excessive heating of the lighting fixtures.

Figure 3:
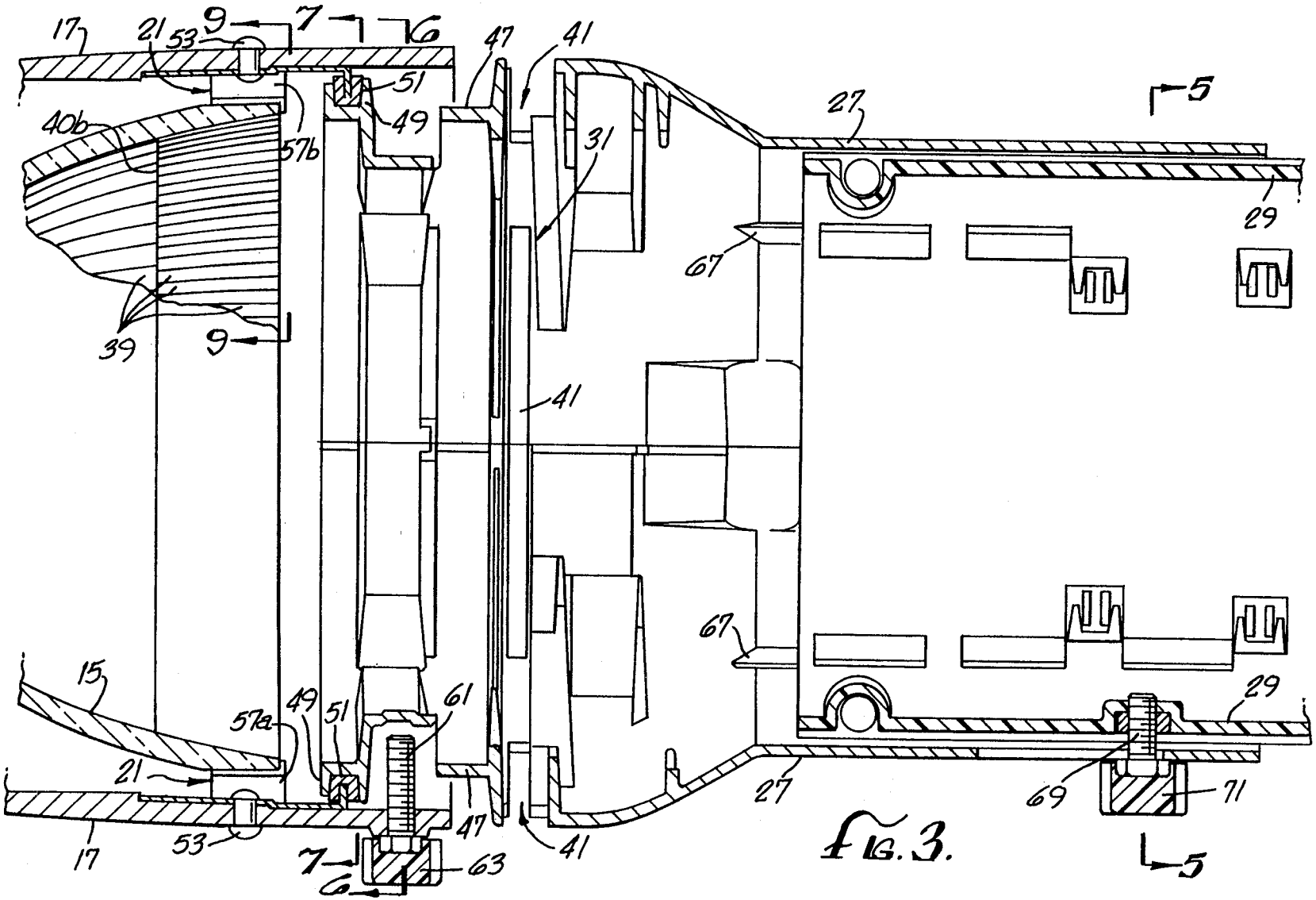
FIG. 3 is a side, sectional view of a midportion of the lighting fixture of FIG. 1, showing the mechanism that allows limited rotation of the front barrel and shutter/-pattern assembly relative to the rear housing.
Figure 4:
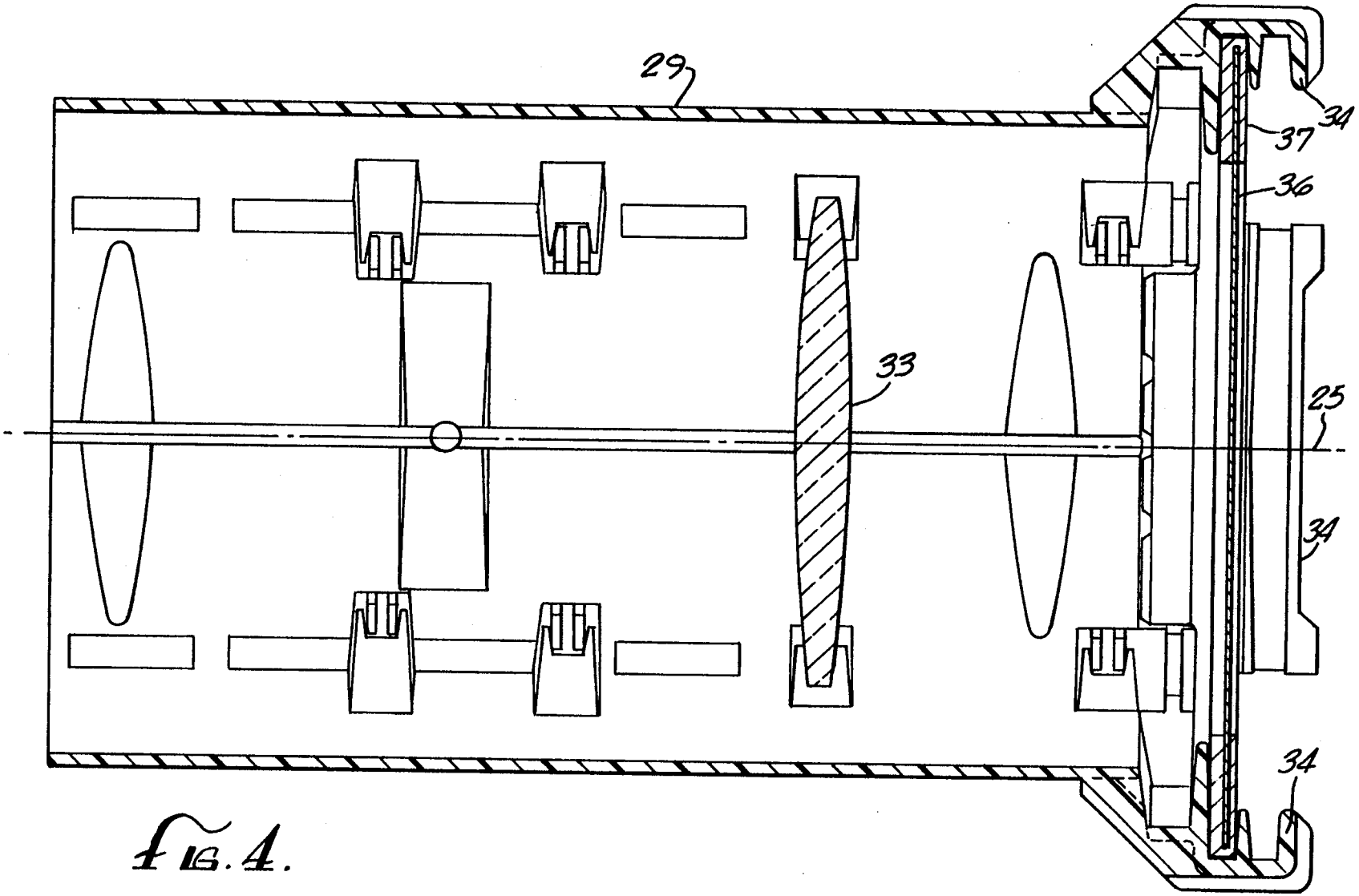
FIG. 4 is a top, sectional view of the lens holder portion of the lighting fixture of FIG. 1, showing the single aspheric lens and a colored gel.
Figure 7:
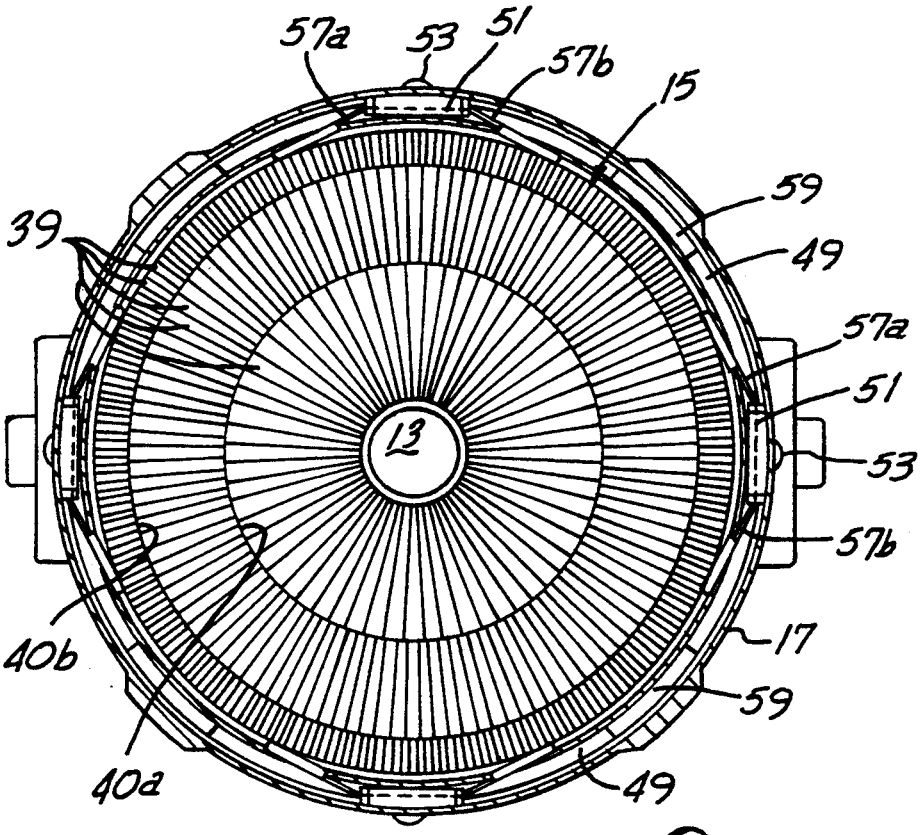
FIG. 7 is a sectional view of the lighting fixture, taken in the direction of the arrows 7—7 in FIG. 3.
Figure 8:
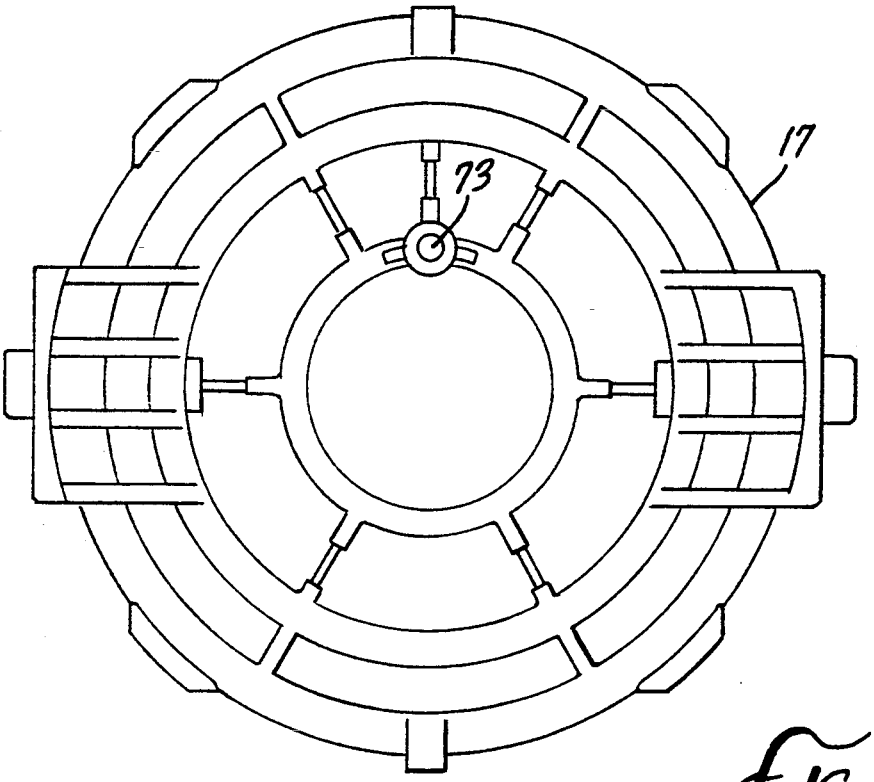
FIG. 8 is a sectional view of the lighting fixture, taken in the direction of the arrows 8—8 in FIG. 2.

In the lighting fixture 11 of the invention, the desired light intensity distribution is achieved by configuring the reflector 15 to be faceted, but only in a circumferential direction. This faceting is depicted in FIGS. 3 and 7. Each facet 39 is substantially flat in a circumferential direction, but follows a generally elliptical curve in a radial direction.

The number of facets 39 increases with increasing radial distance. This increase occurs in two discrete steps identified by the reference numerals 40*a* and 40*b*. Each step represents a doubling in the number of facets. The site of each such step and the circumferential angle of each facet are selected empirically, to provide a desired integrated intensity distribution that is circumferentially uniform.

The effect of each facet 39 is to blur the image of the lamp filaments formed at the gate 31. Because the facets are arranged only circumferentially, this blurring occurs only in directions generally perpendicular to the facet's radial orientation. This has the effect of blurring the regions of high light intensity, but keeping substantially all of the light within the limits of the gate and lens. A substantially circumferentially uniform light intensity across the gate aperture thereby is provided, with minimal wastage of light missing the gate aperture and the lens 33, relative to prior faceting.

In another feature of the invention, the reflector 15 has a dichroic characteristic, reflecting a very high proportion of visible light, while transmitting a very high proportion of infrared light. The reflector is formed of molded borosilicate glass, with a special, multiple-layer, thin-film dielectric coating. In the preferred embodiment, this coating constitutes fifteen or more alternating layers of silicon dioxide and titanium oxide or tantalum oxide. Each such layer has a thickness substantially less than the wavelength of visible light.

Configuring the reflector 15 to be dichroic, as described above, ensures that a much higher proportion of the projected light is in the visible spectrum, and thus useful. Only about 10% of the emitted infrared light, which would serve only to heat the objects being illuminated without at the same time providing any visible illumination, is projected. Moreover, the dichroic glass reflector reflects about 95% of visible light, which is substantially higher than prior polished aluminum reflectors.

In addition, reducing the amount of forwardly-directed infrared light reduces correspondingly the undesired heating of the fixture's front barrel 27 and lens tube 29, including the shutter/pattern assembly 31, lens 33, and colored media 36. This, in turn, allows those components to be made smaller, and thus lighter and less expensive to manufacture, without bringing about an excessively high energy density.

The lens 33 located within the lens tube 29 receives light reflected by the reflector 15 through the shutter/-pattern assembly 31 and images that light at a distant location. The lens preferably is configured to be a single aspheric lens, which substantially corrects spherical aberration, astigmatism, and field curvature in the projected beam. This has several advantages over prior lens systems that included multiple plano-convex lenses with one spherical surface each. Because just a single lens is included, reflection losses are dramatically reduced and efficiency therefore is increased. Since a 4 percent reflection loss typically occurs at each lens surface, the elimination of one lens leads to an 8 percent gain in efficiency. Further, using just a single lens reduces the fixture's overall weight, reduces the cost of applying anti-reflection coatings, and facilitates cleaning of the lens during use, since both sides of the lens are readily accessible. Although aspheric lenses generally are substantially more expensive than spherical lenses, it is a cost-effective alternative in this case, because of the resulting substantial increase in the fixture's efficiency and because the smaller lens size (resulting from use of the dichroic reflector 15) dramatically reduces the aspheric lens' manufacturing cost.

Reducing the amount of forwardly-directed infrared light also facilitates a better use of colored media 36. Overheating, and thus burning, of the media can be eliminated. Even highly-absorptive blue media can be used without fear of their being damaged. In addition, the reduction in the media size leads to yet a further cost savings.

As previously mentioned, the shutter/pattern assembly 31 is located at the rearward end of the front barrel 27, which is substantially at the second focal region of the near-ellipsoidal reflector 15. The projected beam's cross-section can be shaped at this location, and that same shape is then imaged at the distant location. To facilitate this shaping, four circumferentially-oriented slots 41 (thru shown in FIG. 3) are formed in the front barrel and sized to slidably receive four shutters 43 (FIG. 1) configured to be selectively slidable into the path of the beam being projected. One of the slots 41 is sized also to slidably receive a pattern 45 (FIG. 1) configured to be selectively slidable into the path of the beam.

In the past, the ability to shape selected portions of the beam being projected was limited, because shutters typically were insertable into the beam's path from only four angularly fixed positions, except on very expensive and sophisticated fixtures. Although the shutters could each be tilted and rotated to a limited extent, they could not be tilted sufficiently to allow complete freedom in the shaping of the projected beam. In the fixture 11 of the invention, however, this drawback is overcome by configuring the front barrel 27 to be selectively rotatable by ±25 degrees relative to the rear housing 17.

Rotation of the front barrel 27 relative to the rear housing 17 is accomplished by means of a cylindrical extension 47 projecting rearwardly from the barrel and sized to slidably fit within the forward part of the rear housing. The rearward end of this cylindrical extension includes an outwardly-directed annular channel 49 extending completely around its periphery. This channel is sized to receive four runners 51 secured within the rear housing, at locations spaced circumferentially 90° apart.

More particularly, the runners 51 are secured to the spring clips 21 that are used to secure the mouth end of the reflector 15 to the rear housing 17. These spring clips are each secured to the rear housing by a rivet 53. Two spring-biased arms 57*a* and 57*b* (FIGS. 2, 7 and 9) project inwardly from each clip, to engage the mouth end of the reflector and thereby hold the reflector centered within the housing. These arms absorb physical shocks and thereby prevent damage to the glass reflector from normal rough handling. For use in installing the front barrel housing, four openings 59 are formed in the rearward side wall of the channel 49, to allow the front barrel 27 to be slid rearwardly within the rear housing until the four runners are received within the channel. Thereafter, the front barrel may be rotated freely ±25 degrees relative to the rear housing, with the four projections sliding within the channel and thereby maintaining the front barrel axially fixed relative to the rear housing. This front barrel rotatability allows the shutters 43 and pattern 45 to be positioned at a selected circumferential location relative to the beam.

A set screw 61 can be positioned to limit free rotation of the front barrel 27 relative to the rear housing 17, so as to prevent it from rotating to an orientation where the runners 51 are aligned with the channel openings 59, in which case the front barrel could fall by gravity from the housing. Complete removal of the set screw is required to allow the front barrel to be rotated to its removal position. An enlarged head 63 on the set screw allows this rotational adjustment to be performed conveniently by hand, without the need for any special tools.

Figure 5:
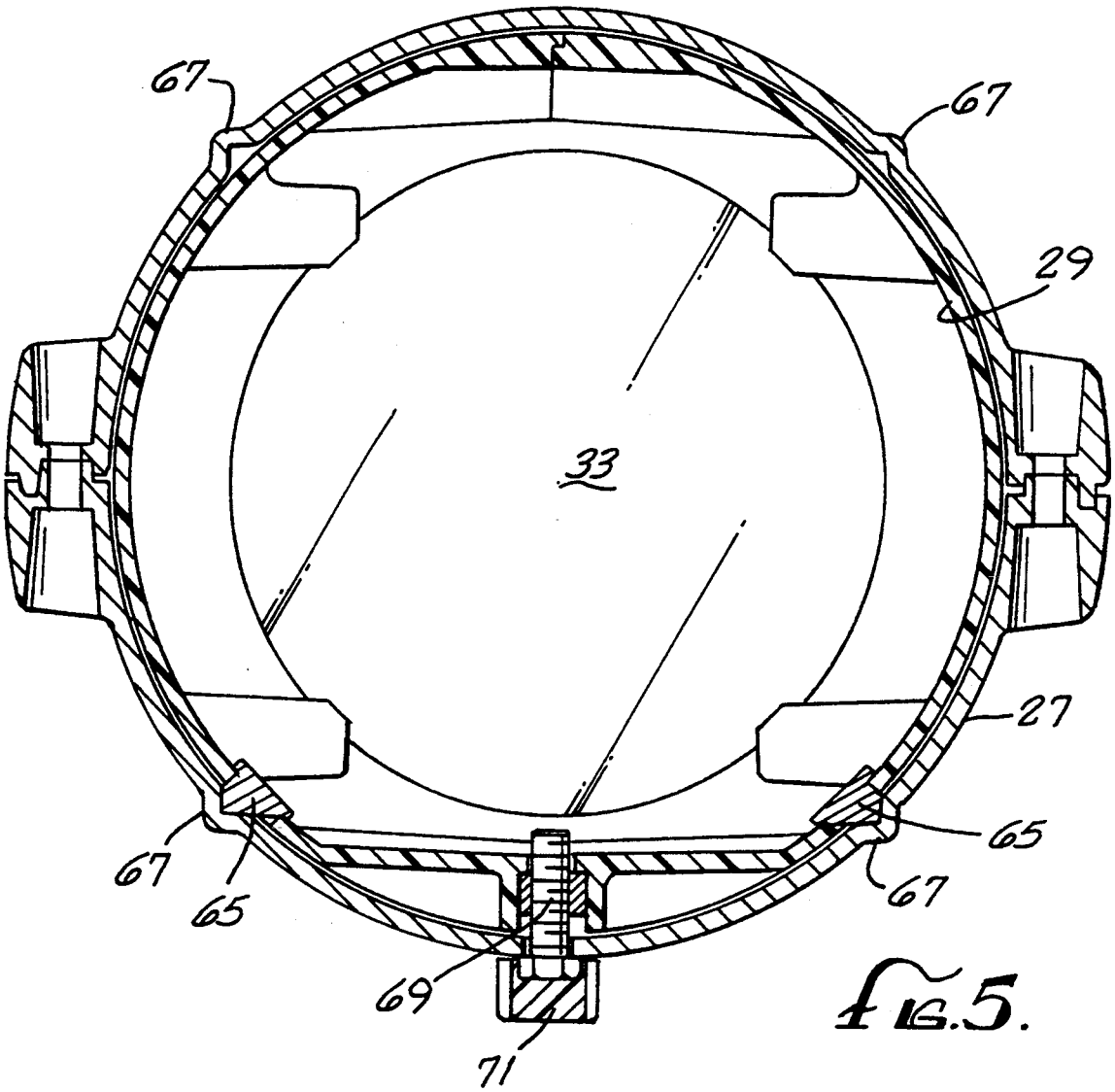
FIG. 5 is a sectional view of the lighting fixture, taken in the direction of the arrows 5—5 in FIG. 3.
Figure 6:
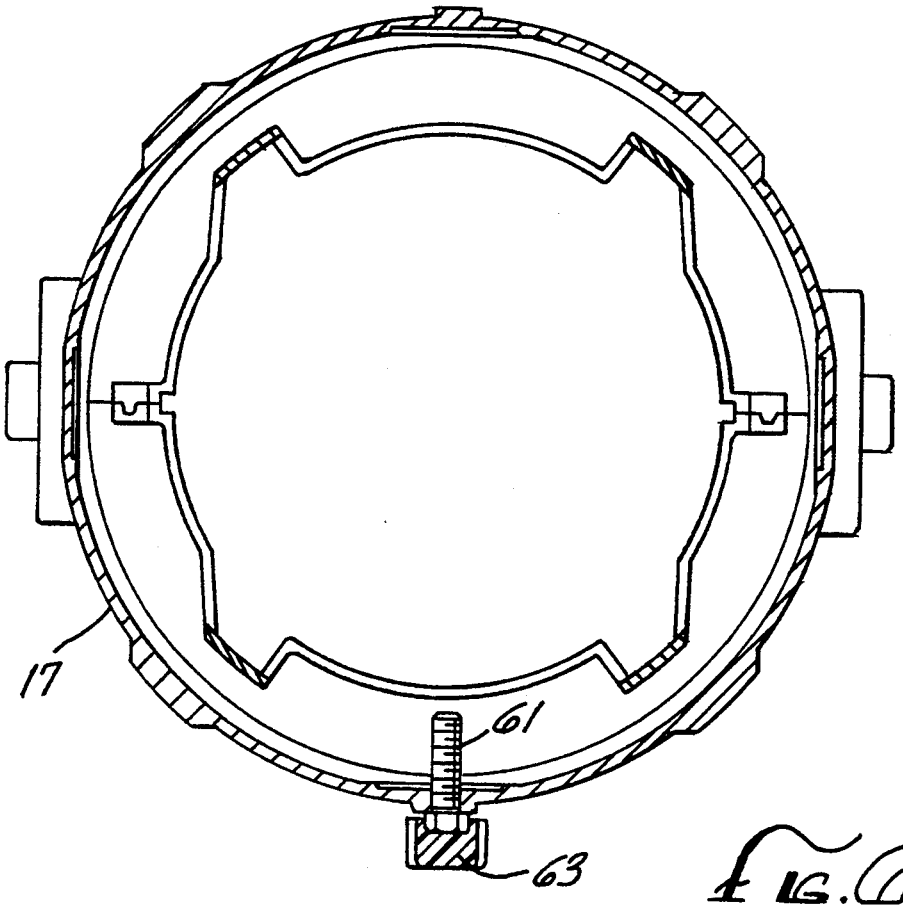
FIG. 6 is a sectional view of the lighting fixture, taken in the direction of the arrows 6—6 in FIG. 3.

As best shown in FIGS. 3 and 5, the front barrel 27 and lens tube 29 are configured to be telescopically slidable relative to each other. This enables the lens 33 to be selectively positioned relative to the gate 31, so as to image the beam at a selected range. Elongated Teflon guides 65 secured to the outer side of the lens tube are received within correspondingly shaped V tracks 67 in the inner side of the front barrel. The guides and tracks are oriented longitudinally, to allow the lens tube to be slid manually to a selected longitudinal position relative to the front barrel. A set screw 69 with an enlarged head 71 for manual gripping can be tightened to lock the lens tube in its selected position.

As previously mentioned, and with reference again to FIGS. 2 and 9, the reflector is supported within the housing 17 by a coil spring 19 and four spring clips 21. This spring mounting allows for differential thermal expansion and also provides limited shock absorption for the reflector.

Provision for an annular space encircling the reflector 15 and numerous ventilation openings in the rear housing 17, burner assembly 23, and front barrel 27 ensure that the lighting fixture 11 is adequately cooled. A power cable 72 supplies power to the lamp 13.

With reference again to FIG. 2, the burner assembly 23 that supports the lamp 13 is secured to the rear portion of the rear housing 17 by means of a single screw 73. An enlarged screw head enables the screw to be tightened and released manually. The lamp itself is held by a socket 77 that is secured to a floating plate 79 that is positioned forwardly of a rear plate 81 of the burner assembly. A bolt 83 projects rearwardly from the floating plate, for use in controllably positioning the floating plate and, thereby, the socket and the lamp. Encircling the threaded shaft of the bolt are, successfully, a compression spring 85, an externally-threaded sleeve 87, and a nut 89 threaded to the sleeve. The sleeve projects through an opening 91 in the burner assembly's rear plate 81, and the rear plate is captured between the nut 89 and a lateral extension 93 of the sleeve. The lateral extension 93 is received in a correspondingly shaped recess of the base floating 79, to prevent relative rotation. An enlarged cap 95 for the nut 89 provides a knob that enables the nut to be tightened and untightened manually. When the nut is untightened, the nut, sleeve and bolt are free to be moved a limited distance in any direction transverse to the lamp's longitudinal axis. Tightening the nut then fixes the selected transverse position.

Threaded to a portion of the threaded shaft of the bolt 83 projecting rearwardly from the sleeve 87 is a nut 97 with an enlarged cap 99. Rotation of this nut moves the head of the bolt 83 axially, under the bias of the compression spring 85, to position the floating plate 79 axially relative to the housing 17. This, in turn, positions the filaments 38 of the lamp 13 axially relative to the reflector 15.

Thus, the precise physical position of the lamp 13 and its filaments 38 relative to the reflector 15 can be conveniently adjusted using two concentrically-arranged knobs 95 and 99. In addition, this adjustment is not disturbed by a removal of the burner assembly 23 by means of the screw 73.

It should be appreciated from the foregoing description that the present invention provides an improved lighting fixture for use with a lamp in imaging a high-intensity beam of light at a distant location. A near-elliptical reflector reflects a high proportion of visible light emitted by the lamp through a gate aperture and, in turn, through a lens to produce the beam being projected. The reflector includes elongated, radially-oriented facets for blurring the projected light so as to provide a desired intensity distribution for the beam, with minimal misdirected light. Further, the reflector has a dichroic coating that reflects very little infrared light, whereby the projected beam's energy density is minimized. The gate is rotatable relative to the fixture's rear housing, whereby the projected beam's shape can conveniently be controlled using a conventional shutter.

Although the invention has been described in detail with reference to the presently preferred embodiment, those of ordinary skill will appreciate that various modifications can be made without departing from the invention. Accordingly, the invention is defined with reference only to the following claims.

I claim:

1. A lighting fixture for use in combination with a lamp having a plurality of elongated filaments with longitudinal axes arranged substantially uniformly around a central longitudinal axis, the combination imaging a beam of light at a distant location, the lighting fixture comprising:

a concave, substantially ellipsoidal reflector having a base at one end and a mouth at the other end, wherein the reflector is substantially circumferentially symmetrical about a longitudinal axis, wherein the reflector has two focal regions, including a first focal region located near the reflector's base and a second focal region located beyond the reflector's mouth, and wherein the reflector has a reflective surface configured to be dichroic, having a substantially higher reflectance at visible wavelengths than at infrared wavelengths;

a rear housing for supporting the reflector;

means for supporting the lamp adjacent the base of the concave reflector, with the lamp's central longitudinal axis substantially coincident with the reflector's longitudinal axes and with the lamp's filaments substantially coincident with the first focal region, such that light emitted by the lamp is reflected by the reflector toward the second focal region;

a gate aperture located substantially at the second focal region of the reflector;

a lens having a predetermined focal length and positioned beyond the gate aperture by a distance corresponding generally to its focal length, such that the lens images the light passing through the gate aperture at a distant location;

wherein the concave reflector includes a plurality of facets arranged substantially uniformly around its circumference, each facet being substantially flat circumferentially, but curved radially;

a generally cylindrical front barrel having a longitudinal axis;

means for securing the front barrel to the rear housing with the longitudinal axis of the front barrel substantially coincident with the longitudinal axis of the reflector; and one or more shutters and a pattern slidably received in the front barrel, substantially at the gate aperture, and selectively slidable into the path of light passing therethrough;

wherein the means for securing the front barrel is configured to allow the front barrel to be selectively rotatable relative to the rear housing, about the barrel, such that the shutter can intercept a selected portion of the light passing therethrough.

2. A lighting fixture for use in combination with lamp to image a beam of light at a distant location, the light fixture comprising:

a substantially ellipsoidal reflector having a base at one end and a mouth at the other end and further having a first focal region near the base and a second focal region beyond the mouth, a longitudinal axis thereby being defined, wherein the reflector has a reflective surface configured to be dichroic, having a substantially higher reflectance at visible wavelengths than at infrared wavelengths;

a rear housing for supporting the reflector;

means secured to the rear housing for supporting the lamp adjacent the base of the reflector, with one or more filaments of the lamp located substantially coincident with the first focal region of the reflector, wherein light emitted by the lamp is reflected by the reflector toward the second focal region of the reflector;

a generally cylindrical front barrel having a longitudinal axis;

means for securing the front barrel to the rear housing with the longitudinal axis of the front barrel substantially coincident with the longitudinal axis of the reflector; and one or more shutters slidably received in the front barrel substantially at the second focal region of the reflector and selectively slidable into the path of light reflected thereto;

wherein the means for securing the front barrel is configured to allow the front barrel to be selectively rotatable relative to the rear housing, about the coincident longitudinal axes of the reflector and the front barrel, such that the shutter can intercept a selected portion of the light.

3. A lighting fixture as defined in claim 2, wherein the means for securing the front barrel includes:

means for defining an annular channel at a rearward end of the front barrel; and a plurality of runners secured to the rear housing and sized to be slidably received in the annular channel.

4. A lighting fixture as defined in claim 2, and further including:

a generally cylindrical lens tube telescopically received within the front barrel; and a lens located within the lens tube, for imaging at a distant location light reflected by the reflector to the second focal region of the reflector, the lens being a single aspheric lens that substantially corrects spherical aberrations, astigmatism, and field curvature in the projected beam.

* * * * *

UNITED STATES PATENT AND TRADEMARK OFFICE

CERTIFICATE OF CORRECTION

PATENT NO. : 5,345,371

DATED : September 6, 1994

INVENTOR(S) : David W. Cunningham and Gregory F. Esakoff

It is certified that error appears in the above-identified patent and that said Letters Patent is hereby corrected as shown below:

In column 6, line 18, replace "thru" with --three--.

In column 9, line 12, after "the" and before "barrel" insert --coincident longitudinal axes of the reflector and the front--.

Signed and Sealed this

Eighth Day of November, 1994

*Attest:*

Bruce Lehman

BRUCE LEHMAN

*Attesting Officer*

*Commissioner of Patents and Trademarks*